US005397527A

United States Patent [19]

Rim et al.

[11] Patent Number: 5,397,527

[45] Date of Patent: Mar. 14, 1995

[54] HIGH MODULUS POLYESTER YARN FOR TIRE CORDS AND COMPOSITES

[75] Inventors: Peter B. Rim, Midlothian; Charles J. Nelson, Chesterfield; Yousef Mohajer; John A. Young, both of Midlothian, all of Va.

[73] Assignee: AlliedSignal Inc., Morris Township, Morris County, N.J.

[21] Appl. No.: 120,708

[22] Filed: Sep. 13, 1993

Related U.S. Application Data

[63] Continuation of Ser. No. 822,799, Jan. 21, 1992, abandoned, which is a continuation-in-part of Ser. No. 814,872, Dec. 30, 1990, abandoned.

[51] Int. Cl.[6] ..... D01F 6/62

[52] U.S. Cl. ..... 264/210.8; 264/211.15; 264/290.5; 428/364; 528/298

[58] Field of Search ..... 264/210.8, 210.7, 211.14–211.19, 264/235.6, 290.5; 528/308.1, 298; 428/272, 364

[56] References Cited

U.S. PATENT DOCUMENTS

| | | | |
|---|---|---|---|
| 3,616,832 | 11/1971 | Shima et al. | 152/361 |
| 3,929,180 | 12/1975 | Kawase et al. | 152/359 |
| 3,951,905 | 4/1976 | Sano et al. | 528/308.5 |
| 4,000,239 | 12/1976 | Hamana et al. | 264/176 |
| 4,001,479 | 1/1977 | Hamana et al. | 428/272 |
| 4,003,974 | 1/1977 | Chantry et al. | 264/210.8 |
| 4,026,973 | 5/1977 | Shima et al. | 264/235 |
| 4,049,763 | 9/1977 | Mineo et al. | 264/210.8 |
| 4,060,516 | 11/1977 | Kuratsuji et al. | 264/235.6 |
| 4,414,169 | 11/1983 | McClary | 264/210.8 |
| 4,529,368 | 7/1985 | Makansi | 264/211.14 |
| 5,049,447 | 9/1991 | Shindo et al. | 428/373 |
| 5,132,067 | 7/1992 | Nelson et al. | 264/210.8 |
| 5,242,645 | 9/1993 | Sasamoto et al. | 264/210.8 |

FOREIGN PATENT DOCUMENTS

| | | | |
|---|---|---|---|
| 2429043 | 1/1975 | Germany | 264/210.7 |
| 56-49014 | 5/1981 | Japan | 264/176.1 |
| 62-156313 | 7/1987 | Japan | 264/176.1 |
| 62-250221 | 10/1987 | Japan | 264/210.8 |
| 4119119 | 4/1992 | Japan | 264/210.7 |
| 1325107 | 8/1973 | United Kingdom | D01F 7/04 |
| 1445464 | 8/1976 | United Kingdom | D01F 6/62 |
| 90-00638 | 1/1990 | WIPO | 264/210.8 |

*Primary Examiner*—Jeffery R. Thurlow

*Attorney, Agent, or Firm*—Gus T. Hampilos; Roger H. Criss; Melanie L. Brown

[57] ABSTRACT

Yarns are prepared by spinning PEN or other semi-crystalline polyester polymers made from similarly rigid monomer combinations to a state of optimum amorphous orientation and crystallinity. This is accomplished by selection of process parameters to form an undrawn polyester yarn of birefringence at least 0.030. The spun yarn is then hot drawn to a total draw ratio of between 1.5/1 and 6.0/1 with the resulting drawn semi-crystalline polyester yarn having Tg greater than 100° C. and a melting point elevation at least 8° C. The preferred yarn has a tenacity at least 6.5 g/d, dimensional stability (EASL+Shrinkage) of less than 5%, and shrinkage 4% or less. The resulting yarn exhibits surprisingly high modulus and tenacity together with low shrinkage when compared to prior art yarns.

22 Claims, 1 Drawing Sheet

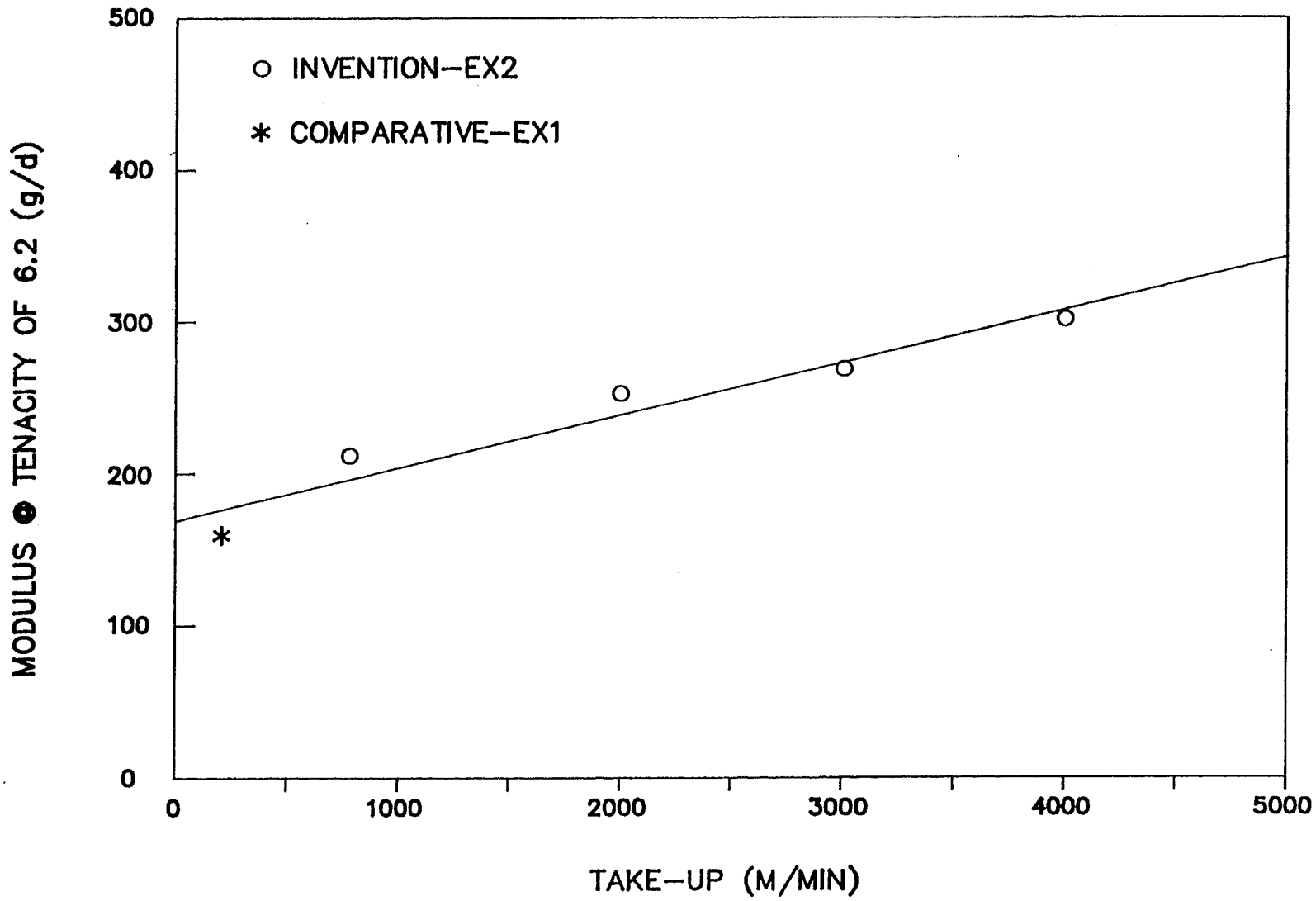
○ INVENTION–EX2
* COMPARATIVE–EX1
MODULUS @ TENACITY OF 6.2 (g/d)
500
400
300
200
100
0
0
1000
2000
3000
4000
5000
TAKE–UP (M/MIN)

HIGH MODULUS POLYESTER YARN FOR TIRE CORDS AND COMPOSITES

This application is a continuation of application Ser. No. 07/822,799, filed Jan. 21, 1992, (pending), which is a continuation-in-part of Ser. No. 07/814,872, filed Dec. 30, 1991, (abandoned).

FIELD OF THE INVENTION

This invention relates to polyethylene naphthalate (PEN) multifilament yarn and other yarns made from similarly rigid monomer combinations with extremely high modulus, good tenacity, and low shrinkage particularly useful for the textile reinforcement of tires. The PEN yarn of this invention provides enhanced modulus and dimensional stability when compared to conventionally processed PEN yarns. A process for production of the multi-filament PEN yarn is an aspect of this invention.

DESCRIPTION OF RELATED ART

Currently, polyethylene terephthalate (PET) filaments are commonly used in industrial applications including radial tire bodies, conveyor belts, seat belts, V belts and hosing. However, higher modulus and dimensional stability is preferred in more demanding applications such as bodies of monoply high performance tires and is required in the belts of radial passenger tires. Dimensional stability is defined as the sum of the elongation at 4.5 g/d. and shrinkage. U.S. Pat. No. 3,616,832 to Shima et al. provides rubber articles reinforced with PEN of good dimensional stability and tenacity and U.S. Pat. No. 3,929,180 to Kawase et al. provides a tire with PEN used as a carcass reinforcement. However, these patents are concerned with conventionally processed PEN of low undrawn birefringence and hence do not achieve the full property potential of this material as is the object of this invention. The same is true of British Patent 1,445,464 to Hamana et al. which teaches optimized drawing of conventionally spun PEN. U.S. Pat. No. 4,000,239 to Hamana et al. provides a process for producing a high melting point, heat resistant undrawn PEN for electrically insulating fabrics. Since these materials were prepared under high stress conditions favoring high crystallinity or at least highly nucleated structures, they lack drawability and cannot attain high modulus for the applications contemplated herein. A product for the same application is provided in U.S. Pat. No. 4,001,479 to Hamana et al., which is concerned with partially oriented yarns of high elongation and low tenacity.

SUMMARY OF THE INVENTION

The yarns of this invention are prepared by spinning PEN or other semi-crystalline polyester polymers made from similarly rigid monomer combinations to a state of optimum amorphous orientation and crystallinity. The invention is accomplished by selection of process parameters to form an undrawn polyester yarn of birefringence at least 0.030. The spun yarn is then hot drawn to a total draw ratio of between 1.3/1 and 6.0/1 with the resulting drawn semi-crystalline polyester yarn having Tg greater than 100° C. and a melting point elevation of at least 8° C. The preferred yarn has a tenacity at least 6.5 g/d, dimensional stability (EASL+Shrinkage) of less than 5%, and shrinkage 4% or less, can be produced by a process utilizing a total draw ratio of at least 1.3, and exhibits a melt point elevation of at least 10° C.

The resulting yarn exhibits surprisingly high modulus and tenacity together with low shrinkage when compared to prior art yarns.

BRIEF DESCRIPTION OF THE DRAWINGS

FIG. 1 represents a comparison of modulus at a tenacity of 6.2 g/d for the PEN yarns of Examples 1 and 2.

DESCRIPTION OF THE PREFERRED EMBODIMENT

The polyester multifilament yarn of the present invention provides high modulus, high dimensional stability and good tenacity, characteristics which are extremely desirable when this material is incorporated as fibrous reinforcement into rubber composites such as tires. PEN multifilament yarns or other yarns of polyester polymers made from similarly rigid monomer combinations can be used advantageously to reinforce two parts of a radial passenger tire, the carcass and the belt. Currently, passenger tire carcasses are reinforced primarily by polyethylene terephthalate.

Two tire characteristics which are controlled by the carcass cord property of dimensional stability (modulus at a given shrinkage) are sidewall indentations and tire handling. The high modulus and dimensional stability of the PEN or other polyester yarns of this invention relative to PET and prior art PEN yarns means that tires with carcasses reinforced with the yarns of this invention will exhibit lower sidewall indentation and better handling behavior. The yarns of this invention are also a desirable reinforcement material because of their high glass transition temperature (Tg) greater than 100° C., i.e. 120° C. for PEN, compared to a Tg of 80° C. for PET. The high Tg will result in lower cord heat generation over a wider temperature range relative to PET tires, resulting in longer tire lifetimes and overall cooler tire operating temperatures. In addition, since modulus tends to drop precipitously at temperatures above Tg, the yarns of this invention will maintain modulus over a wider temperature range than PET. All of the above mentioned advantages will be of critical importance when yarns of this invention are used to reinforce high performance tires since this application requires low cord heat generation and high modulus, especially at elevated operating temperatures characteristic of high speed performance driving.

PEN multifilament yarns and other polyester yarns of this invention can also be used to reinforce the belts of radial passenger tires and the carcasses of radial truck tires. Currently steel is used for these applications since PET possesses insufficient strength and modulus for a given cord diameter. The high modulus of PEN relative to PET, and the additional modulus advantages of the PEN of this invention will make PEN an ideal material to be used as a steel substitute.

The polyethylene naphthalate yarn of the invention contains at least 90 mol percent polyethylene naphthalate. In a preferred embodiment, the polyester is substantially all polyethylene naphthalate. Alternatively, the polyester may incorporate as copolymer units minor amounts of units derived from one or more ester-forming ingredients other than ethylene glycol and 2,6 naphthylene dicarboxylic acid or their derivatives. Illustrative examples of other ester forming ingredients which may be copolymerized with the polyethylene naphthalate units include glycols such as 1,3-propanediol, 1,4-butanediol, 1,6-hexanediol, etc., and dicarboxylic acids such as terephthalic acid, isophthalic acid, hexahydroterephthalic acid, stilbene dicarboxylic acid, bibenzoic acid, adipic acid, sebacic acid, azelaic acid, etc.

Other polyester yarns of the invention can be prepared to contain polyester polymer made from suitable combinations of rigid and flexible monomers providing the resulting polymer is melt-spinnable, is semi-crystalline, and has a Tg greater than 100° C. Examples of rigid monomers include dicarboxylic acids such as 2,6-naphthalene dicarboxylic acid, 2,7-naphthalene dicarboxylic acid, diphenyl dicarboxylic acid, stilbene dicarboxylic acid and terephthalic acid; dihydroxy compounds such as hydroquinone, biphenol, p-xylene glycol, 1,4 cyclohexanedimethanol, neopentylene glycol; and hydroxycarboxylic acid such as P-hydroxybenzoic acid and 7-hydroxy-$\beta$-naphthoic acid. Examples of flexible monomers include dicarboxylic acids such as oxalic acid, succinic acid, adipic acid, sebacic acid, and dihydroxy compounds such as ethylene glycol, 1,3 propanediol, 1,4 butanediol, 1,6 hexanediol. It is important that the thermal stability of the polymer above its melting point be sufficient to allow melt processing without excessive degradation.

The multi-filament yarn of the present invention commonly possesses a denier per filament of about 1 to 20 (e.g. about 3 to 10), and commonly consists of about 6 to 600 continuous filaments (e.g. about 20 to 400 continuous filaments). The denier per filament and the number of continuous filaments present in the yarn may be varied widely as will be apparent to those skilled in the art.

The multi-filament yarn is particularly suited for use in industrial applications wherein high strength polyester fibers have been utilized in the prior art. The fibers are particularly suited for use in environments where elevated temperatures (e.g. 100° C.) are encountered. Not only does the filamentary material provide enhanced modulus but it undergoes a very low degree of shrinkage for a high modulus fibrous thermoplastic.

The unexpected dimensional stability advantage seems to originate from the formation of a unique morphology during spinning which arises from the crystallization of highly oriented amorphous regions characterized by an undrawn birefringence of at least 0.03, preferably 0.03 to 0.30. This crystallization occurs in either the drawing stage or the spinning stage depending on the level of stress imposed during spinning. If too much stress is applied during spinning, the undrawn yarns tend to lack drawability and characteristically exhibit melting points greater than 290° C. for PEN.

The characterization parameters referred to herein may conveniently be determined by testing the multifilament yarn which consists of substantially parallel filaments.

1. BIREFRINGENCE—Birefringence was determined using a polarizing light microscope equipped with a Berek compensator. If the black primary extinction band is not visible the purple colored band should be used for this measurement.

2. DENSITY—Densities were determined in a n-heptane/carbon tetrachloride density gradient column at 23° C. The gradient column was prepared and calibrated according to ASTM D1505-68.

3. MELTING POINT—Melting points were determined with a Perkin—Elmer Differential Scanning Calorimeter (DSC) from the maxima of the endotherm resulting from scanning a 10 mg sample at 20° C. per minute. Tg is to be taken under the same experimental conditions as the inflection point in the change heat capacity associated with the glass transition temperature. Melting point elevation for drawn yarns ($\Delta$Tm) is defined as:

$$\Delta Tm = Tm^{1} - Tm^{11}$$

where $Tm^{1}$ is the melting point of the drawn yarn of interest and $Tm^{11}$ is the melting point of a yarn which is pre-melted and rapidly cooled in the DSC before analysis.

4. INTRINSIC VISCOSITY—Intrinsic viscosity (IV) of the polymer and yarn is a convenient measure of the degree of polymerization and molecular weight. IV is determined by measurement of relative solution viscosity ($\eta_r$) in a mixture of phenol and tetrachloroethane (60/40 by weight) solvents. $\eta_r$ is the ratio of the flow time of a PEN/solvent solution to the flow time of pure solvent through a standard capillary. IV is calculated by extrapolation of relative solution viscosity data to a concentration of zero.

5. PHYSICAL PROPERTIES—The tensile properties referred to herein were determined through the utilization of an Instron tensile tester using a 10 inch gauge length and a strain rate of 120 percent per minute. All tensile measurements were made at room temperature. Dimensional stability refers to the level of stress achieved at a given shrinkage. In the tire industry, dimensional stability is defined as the sum of elongation at a specified load plus shrinkage. For the present case, the elongation at a specified load (EASL) is derived from the initial modulus data using the following equation:

$$\text{EASL} = 454/\text{Modulus (g/d)}$$

It is well known that tenacity and modulus increase with increasing draw-ratio. While higher tenacity per se is almost always highly desirable, the high extension ratios are often not achievable due to yarn quality problems or to excessive shrinkage. Materials of this invention possess high levels of modulus for a given level of tenacity. This is quantified as the $L_T$ parameter, by ratioing L-5 to tenacity as follows:

$$L_T = ((L\text{-}5)^4/T^{5.16})1000$$

L-5 or LASE-5 is a measure of modulus defined as load in g/d at 5% elongation. The materials of this invention have $L_T$ at least 25. If L-5 is not measurable because of yarn elongations less than 5% the yarns will be prerelaxed at elevated temperatures before testing to increase elongation beyond 5%.

Shrinkage values were determined in accordance with ASTM D885 after one minute at 177° C. employing a constraining force of 0.05 g/denier.

Identified hereafter is a description of a process which has been found to be capable of forming the improved yarn of the present invention. The yarn product claimed hereafter is not to be limited by the parameters of the process which follows.

The melt-spinnable polyester is supplied to an extrusion spinnerette at a temperature above its melting point and below the temperature at which the polymer degrades substantially. The residence time at this stage is kept to a minimum and the temperature should not rise above 350° C., preferably 320° C.

The extruded filaments then traverse a conventional yarn solidification zone where quench air impinges on the spun yarn thereby freezing in desirable internal structural features and preventing the filaments from fusing to one another. The solidification zone preferably comprises (a) a retarded cooling zone comprising a gaseous atmosphere heated at a temperature to at least 150° C., preferably 150° to 500° C., and (b) a cooling zone adjacent to said retarded cooling zone wherein said yarn is rapidly cooled and solidified in a blown air atmosphere. The key to the current process is to adjust processing conditions to achieve a highly oriented undrawn yarn of birefringence at least 0.03 and an elevated melting point of 1–25° C., preferably 3–23° C. For PEN a melting point of 266 to 290° C., preferably 268 to 288° C. must be achieved. One skilled in the art can achieve this by adjusting the following conditions: length and temperature of the retarded cooling zone adjacent to the spinnerette, diameter of the spinnerette holes, method of blowing the quench, quench air velocity, and drawdown in the solidification zone. The speed of withdrawal of the yarn from the solidification zone is an important parameter affecting the stress on the spun fiber, and should be adjusted to yield the desired characteristics. The spun yarn is then drawn by conventional means in either a continuous or non-continuous process to yield a drawn yarn with Tg greater than 100° C. and a melting point elevation at least 8° C., preferably 8° to 15° C. It is preferred to have the following drawn yarn properties: tenacity at least 6.5 g/d, preferably at least 7.5 g/d; dimensional stability (EASL+-shrinkage) of less than 5%; and shrinkage of 4% or less. As shown in the Examples, this combination of properties occurred in fibers having a melt point elevation of 10° C. or more.

EXAMPLE I
(COMPARATIVE)

A PEN undrawn yarn was produced by extruding 32 filaments through a spinnerette with orifices of length 0,042 inches and of width 0,021 inches at a thruput of 23.2 cc/min. The filaments were solidified in an air quenching column and taken up at winder speeds of 305 m/min.

This yarn was drawn in two stages using conventional heated rolls. The undrawn yarn properties, drawn yarn properties, and drawing conditions are summarized in Table I.

The yarn of this example, which was prepared conventionally from an undrawn yarn of $\Delta n=0.004$, posseses poorer modulus than the yarns of this invention as evidenced by $L_T$ less than 25. Also the dimensional stability parameter (EASL+shrinkage) of 8.3 is higher than that of yarns of this invention, indicating poorer dimensional stability (see Example III).

TABLE I

| | |
|---|---|
| **A. UNDRAWN YARN** | |
| Δ n | 0.004 |
| Tenacity (g/d) | 0.6 |
| Modulus (g/d) | 18.6 |
| Tm (°C.) | 268 |
| **B. DRAWN YARN** | |
| Draw Ratio | 6.3 |
| Roll 1 (°C.) | 140 |
| Roll 2 (°C.) | 157 |
| Roll 3 (°C.) | RT |
| Δ n | 0.426 |
| Tenacity (g/d) | 6.2 |
| Modulus (g/d) | 176 |
| Tm (°C.) | 272 |
| Shrinkage (%) | 5.7 |
| EASL + Shrink (%) | 8.3 |
| ΔTm (°C.) | 7 |

EXAMPLE II

PEN yarns were produced by extruding seven filaments through a spinnerette with orifices of length 0.036 inches and width of 0.016 inches at a thruput of 9.6 cc/min. The filaments were solidified in an air quenching column and taken up at winder speeds ranging from 770–5000 m/min. These yarns were drawn in two stages using a heating plate in draw zone two. The undrawn yarn properties, drawn yarn properties, and drawing conditions are summarized in Table II. The preferred yarns of the present invention are produceable by a process in which the oriented yarns are drawn to a total draw ratio of at least 1.3. These yarns also exhibited a melt point elevation of at least 10° C. For the more preferred yarn having an initial modulus of at least 280, a melt point elevation of at least 11° C. resulted.

Visual inspection of the data in this example illustrates that for yarns drawn to a given tenacity, modulus increases with increasing spinning speed and with drawn and undrawn melting point. This is reflected in the increasing $L_T$ parameter with increasing spinning speed. Undrawn birefringence alone is not sufficient to characterize the yarns of this invention. Since this parameter is insensitive to morphological changes which occur at high spinning stresses, both melting point and birefringence must be used to define the scope of this invention. In order to compare the data of this example with that of comparative Example I, the modulus values of Table II were interpolated to 6.2 g/d tenacity and plotted vs spinning speed (FIG. 1). This analysis clearly shows the advantages of the yarns of this invention relative to prior art yarns.

TABLE II

| | A. UNDRAWN YARN | | | | |
|---|---|---|---|---|---|
| | TAKE-UP SPEED (m/min) | | | | |
| | 770 | 2000 | 3000 | 4000 | 5000 |
| Δ n | 0.043 | 0.279 | 0.273 | 0.267 | 0.270 |
| Tenacity (g/d) | 1.5 | 3.6 | 4.1 | 5.1 | 7.8 |
| Modulus (g/d) | 24 | 86 | 122 | 151 | 190 |
| Tm (°C.) | 265 | 272 | 281 | 287 | 294 |

| | B. DRAWN YARN | | | | | | | |
|---|---|---|---|---|---|---|---|---|
| | TAKE-UP SPEED (m/min) | | | | | | | |
| | 770 | | 2000 | | 3000 | | 4000 | |
| Draw Ratio | 3.0 | 3.6 | 1.4 | 1.5 | 1.2 | 1.3 | 1.3 | 1.3 |
| Roll 1 (°C.) | 125 | 125 | 125 | 125 | 125 | 125 | 95 | 125 |
| Roll 2 (°C.) | RT | RT | RT | RT | RT | RT | RT | RT |

TABLE II-continued

| | | | | | | | | |
|---|---|---|---|---|---|---|---|---|
| Heating Plate (°C.) | 230 | 230 | 235 | 230 | 240 | 230 | 240 | 230 |
| Δ n | 0.404 | 0.404 | 0.420 | 0.402 | 0.402 | 0.406 | — | 0.369 |
| Tenacity (g/d) | 5.8 | 6.6 | 5.8 | 6.6 | 5.6 | 6.8 | 6.4 | 6.7 |
| Modulus (g/d) | 174 | 257 | 222 | 295 | 255 | 295 | 262 | 323 |
| Tm (°C.) | 274 | 275 | 276 | 276 | 281 | 281 | — | 286 |
| L-5 (g/d) | 3.2 | 5.0 | 4.8 | 5.9 | 4.8 | 5.9 | 6.2 | 5.4 |
| $L_T$ | 12 | 37 | 61 | 72 | 73 | 61 | 102 | 46 |
| Δ Tm | 9 | 10 | 11 | 11 | 16 | 16 | — | 21 |

EXAMPLE III

The undrawn yarns of Example II spun at 770 m/min and 4000 m/min were drawn to their ultimate limit. The 770 m/min sample was drawn in one stage using an oven in the draw zone and the 4000 m/min sample was drawn in two stages using a heated plate in the second draw zone. The drawn yarn properties and drawing conditions are summarized in Table III. This example shows that the yarns of this invention possess extremely high modulus, high tenacity, and low shrinkage making them desirable for in-rubber applications.

TABLE III

| | A DRAWN YARN | |
|---|---|---|
| | Take-up Speed (m/min) | |
| | 770 | 4000 |
| Draw Ratio | 5.9 | 2.0 |
| Roll 1 (°C.) | 120 | 95 |
| Oven (°C.) | 170 | — |
| Roll 2 (°C.) | RT | RT |
| Heating Plate (°C.) | — | 240 |
| Roll 3 (°C.) | — | RT |
| Tenacity (g/d) | 10.3 | 7.6 |
| Modulus (g/d) | 362 | 417 |
| Shrinkage (%) | 3.5 | <1 |
| EASL + Shrink (%) | 4.8 | <2.1 |
| L-5 (g/d) | 8.3 | 7.5 |
| $L_T$ | 28 | 90 |

EXAMPLE IV

This example shows that undrawn yarns of high birefringence, modulus, and melting point can be produced at spinning speeds slower than those of Example II, thereby yielding a more commercially feasible process for those lacking high speed capabilities. PEN yarns were produced by extruding seven filaments through a spinnerette with orifices of length 0.069 inches and width 0.030 inches at a thruput of 9.6 cc/min. The filaments were solidified in an air quenching column and taken up at winder speeds ranging from 410 m/min to 2500 m/min. The properties of these yarns are summarized in

TABLE IV

| | TAKE-UP SPEED (M/MIN) | | | | | |
|---|---|---|---|---|---|---|
| | 410 | 770 | 1200 | 1600 | 2000 | 2500 |
| Δ n | 0.178 | 0.154 | 0.192 | 0.232 | 0.233 | 0.226 |
| Tenacity (g/d) | 2.1 | 2.0 | 2.6 | 3.8 | 4.0 | 4.5 |
| Modulus (g/d) | 64 | 58 | 63 | 114 | 143 | 158 |
| Tm (°C.) | 269 | 267 | 268 | 279 | 291 | 292 |

What is claimed is:

1. A process for production of a drawn polyester yam having a $T_g$ greater than 100° C., comprising:
   (a) extruding a molten crystallizable polyester polymer having an intrinsic viscosity of at least 0.6 through a shaped extrusion orifice to form a molten spun yarn,
   (b) solidifying the molten spun yarn by passing it through a solidification zone,
   (c) withdrawing the solidified yarn at a sufficient undrawn take-up speed to form a partially oriented yarn of birefringence of at least 0.030, and
   (d) hot drawing the partially oriented yarn to a total draw ratio of at least 1.3/1 to form a drawn yarn.

2. The process of claim 1 wherein the spun yarn is solidified by passing through a solidification zone which comprises (a) a retarded cooling zone comprising an atmosphere heated at a temperature of at least 150° C., and (b) a cooling zone adjacent said retarded cooling zone wherein said yarn is rapidly cooled and solidified in a gaseous atmosphere.

3. The process of claim 1 wherein the undrawn take-up speed is 400 to 4500 m/min.

4. The process of claim 1 wherein the undrawn birefringence is 0.030 to 0.30.

5. A process for production of a drawn polyethylene naphthalate yarn, comprising:
   (a) extruding a molten crystallizable polyester polymer having an intrinsic viscosity of at least 0.6 through a shaped extrusion orifice to form a molten spun yarn,
   (b) solidifying the molten spun yarn by passing it through a solidification zone,
   (c) withdrawing the solidified yarn at a sufficient undrawn take-up speed to form a partially oriented yarn of birefringence of at least 0.030, and
   (d) hot drawing the partially oriented yarn to a total draw ratio of at least 1.3/1 to form a drawn yarn.

6. The process of claim 5 wherein the spun yarn is solidified by passing through a solidification zone which comprises (a) a retarded cooling zone comprising an atmosphere heated at a temperature of at least 150° C., and (b) a cooling zone adjacent to said retarded cooling zone wherein said yarn is rapidly cooled and solidified in a gaseous atmosphere.

7. The process of claim 5 wherein the undrawn take-up speed is 400 to 45000 m/min.

8. The process of claim 5 wherein the undrawn birefringence is 0.030 to 0.30.

9. A process for production of a drawn polyester yarn having a $T_g$ greater than 100° C., comprising:
   (a) extruding a molten crystallizable polyester polymer having an intrinsic viscosity of at least 0.6 through a shaped extrusion orifice to form a molten spun yarn,
   (b) solidifying the molten spun yarn by passing it through a solidification zone,
   (c) withdrawing the solidified yarn at a sufficient undrawn take-up speed to form a partially oriented yarn of birefringence of at least 0.030 and a melting point elevation in the range of 3°–23° C., and (d) hot drawing the partially oriented yarn to a total draw ratio of at least 1.3/1 to form a drawn yarn.

10. The process of claim 1 wherein the spun yarn is solidified by passing through a solidification zone which comprises (a) a retarded cooling zone comprising an atmosphere heated at a temperature of at least 150° C., and (b) a cooling zone adjacent said retarded cooling zone wherein said yarn is rapidly cooled and solidified in a gaseous atmosphere.

11. The process of claim 1 wherein the undrawn take-up speed is 400 to 4500 m/min.

12. The process of claim 1 wherein the undrawn birefringence is 0.030 to 0.30.

13. A process for production of a drawn polyethylene naphthalate yarn, comprising:

(a) extruding a molten crystallizable polyester polymer having an intrinsic viscosity of at least 0.6 through a shaped extrusion orifice to form a molten spun yarn, (b) solidifying the molten spun yarn by passing it through a solidification zone, (c) withdrawing the solidified yarn at a sufficient undrawn take-up speed to form a partially oriented yarn of birefringence of at least 0.030 and the melting point elevation is the range of 3°–23° C., and (d) hot drawing the partially oriented yarn to a total draw ratio of at least 1.3/1 to form a drawn yarn.

14. A drawn semi-crystalline polyester multifilament yarn having $T_g$ greater than 100° C., a melting point elevation of least 10° C., a tenacity of at least 7.5 g/d, dimensional stability (EASL+shrinkage) of less than 5%, and shrinkage of 4% or less.

15. The drawn yarn of claim 14 wherein the melting point elevation is at least 11° C.

16. The drawn yarn of claim 14 wherein the initial modulus is at least 280 g/d.

17. A drawn semi-crystalline polyethylene naphthalate multifilament yarn having $T_g$ greater than 100° C., a melting point elevation at least 10° C., a tenacity at least 7.5 g/d, dimensional stability (EASL+shrinkage) of less than 5%, and shrinkage of 4% or less.

18. The drawn polyethylene naphthalate yarn of claim 17 wherein the melting point elevation is at least 11° C.

19. The drawn polyethylene naphthalate yarn of claim 17 wherein the initial modulus is at least 280 g/d.

20. A process for production of a drawn polyester yarn having a $T_g$ greater than 100° C., comprising:

(a) extruding a molten crystallizable polyester polymer having an intrinsic viscosity of at least 0.6 through a shaped extrusion orifice to form a molten spun yarn, (b) solidifying the molten spun yarn by passing it through a solidification zone, (c) withdrawing the solidified yarn at a sufficient undrawn take-up speed to form a partially oriented yarn of birefringence of at least 0.030, and (d) hot drawing the partially oriented yarn to a total draw ratio of at least 1.3/1 to form a drawn yarn having a tenacity of at least 6.5 g/d and dimensional stability of less than 5%.

21. A process for production of a drawn polyethylene naphthalate yarn, comprising:

(a) extruding a molten crystallizable polyester polymer having an intrinsic viscosity of at least 0.6 through a shaped extrusion orifice to form a molten spun yarn, (b) solidifying the molten spun yarn by passing it through a solidification zone, (c) withdrawing the solidified yarn at a sufficient undrawn take-up speed to form a partially oriented yarn of birefringence of at least 0.030, and (d) hot drawing the partially oriented yarn to a total draw ratio of at least 1.3/1 to form a drawn yarn having a tenacity of at least 7.5 g/d and dimensional stability of less than 5%.

22. A process for production of a drawn polyethylene naphthalate yarn, comprising:

(a) extruding a molten crystallizable polyester polymer having an intrinsic viscosity of at least 0.6 through a shaped extrusion orifice to form a molten spun yarn, (b) solidifying the molten spun yarn by passing it through a solidification zone, (c) withdrawing the solidified yarn at a sufficient undrawn take-up speed to form a partially oriented yarn of birefringence in the range of 0.030 to 0.30, and (d) hot drawing the partially oriented yarn to a total draw ratio of at least 1.3/1 to form a drawn yarn having a tenacity of at least 7.5 g/d and dimensional stability of less than 5%.

* * * * *

UNITED STATES PATENT AND TRADEMARK OFFICE

CERTIFICATE OF CORRECTION

PATENT NO. : 5,397,527

DATED : March 14, 1995

INVENTOR(S) : Rim et al.

It is certified that error appears in the above-identified patent and that said Letters Patent is hereby corrected as shown below:

On cover sheet, item [63], "Related U.S. Application Data" delete "Dec. 30, 1990", and insert--Dec. 30. 1991--.

Signed and Sealed this

Twenty-seventh Day of June, 1995

Bruce Lehman

*Attest:*

BRUCE LEHMAN

*Attesting Officer*

*Commissioner of Patents and Trademarks*